US007153253B2

(12) United States Patent
Müller

(10) Patent No.: US 7,153,253 B2
(45) Date of Patent: Dec. 26, 2006

(54) FOLDING DRUMS OF A FOLDING DEVICE

(75) Inventor: Robert Müller, Heuchelheim (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 204 days.

(21) Appl. No.: 10/504,843

(22) PCT Filed: Jan. 31, 2003

(86) PCT No.: PCT/DE03/00268
§ 371 (c)(1),
(2), (4) Date: Aug. 26, 2004

(87) PCT Pub. No.: WO03/072476
PCT Pub. Date: Sep. 4, 2003

(65) Prior Publication Data

US 2005/0150319 A1 Jul. 14, 2005

(30) Foreign Application Priority Data

Feb. 26, 2002 (DE) ..... 102 08 017
Feb. 26, 2002 (DE) ..... 102 08 292

(51) Int. Cl.
*B31F 1/08* (2006.01)
*B31F 1/10* (2006.01)

(52) U.S. Cl. ..... 493/426; 493/424; 493/356; 493/359; 270/20.1

(58) Field of Classification Search ..... 493/424–426, 493/356, 359; 270/5.01, 8, 41, 20.1; 74/321, 74/340, 352, 358, 640
See application file for complete search history.

(56) References Cited

U.S. PATENT DOCUMENTS

| | | | | |
|---|---|---|---|---|
| 2,919,914 | A * | 1/1960 | Harless | 493/431 |
| 3,865,361 | A | 2/1975 | Neal | |
| 4,190,243 | A * | 2/1980 | Michalik et al. | 493/356 |
| 5,017,184 | A * | 5/1991 | Takahori et al. | 493/368 |
| 5,215,014 | A * | 6/1993 | Burger et al. | 101/248 |
| 5,741,209 | A | 4/1998 | Hillebrand et al. | |
| 5,830,120 | A | 11/1998 | Rumesz et al. | |
| 5,983,753 | A | 11/1999 | Kostiza | |
| 6,004,242 | A * | 12/1999 | Kostiza | 475/341 |
| 6,550,385 | B1 * | 4/2003 | Colin et al. | 101/228 |
| 7,011,617 | B1 * | 3/2006 | Sappal et al. | 493/424 |

FOREIGN PATENT DOCUMENTS

| | | |
|---|---|---|
| DE | 1 222 082 | 9/1960 |
| DE | 41520 | 9/1965 |
| DE | 295 02 957.9 | 2/1995 |
| DE | 195 11 054 C2 | 3/1995 |
| DE | 196 25 083 C1 | 6/1996 |
| DE | 197 55 428 A1 | 12/1997 |
| GB | 1059158 | 4/1965 |
| GB | 2066785 A | 12/1980 |

* cited by examiner

*Primary Examiner*—Hermant M. Desai
(74) *Attorney, Agent, or Firm*—JonesTullar&Cooper, P.C.

(57) ABSTRACT

A folding drum of a folding device is comprised of at least one folding element and a transmission unit. The transmission unit has at least one toothed wheel which is coaxially arranged with respect to the rotational axis of the folding drum. The toothed wheel can be moved in the axial direction of the folding drum between at least two positions.

37 Claims, 3 Drawing Sheets

Fig. 1
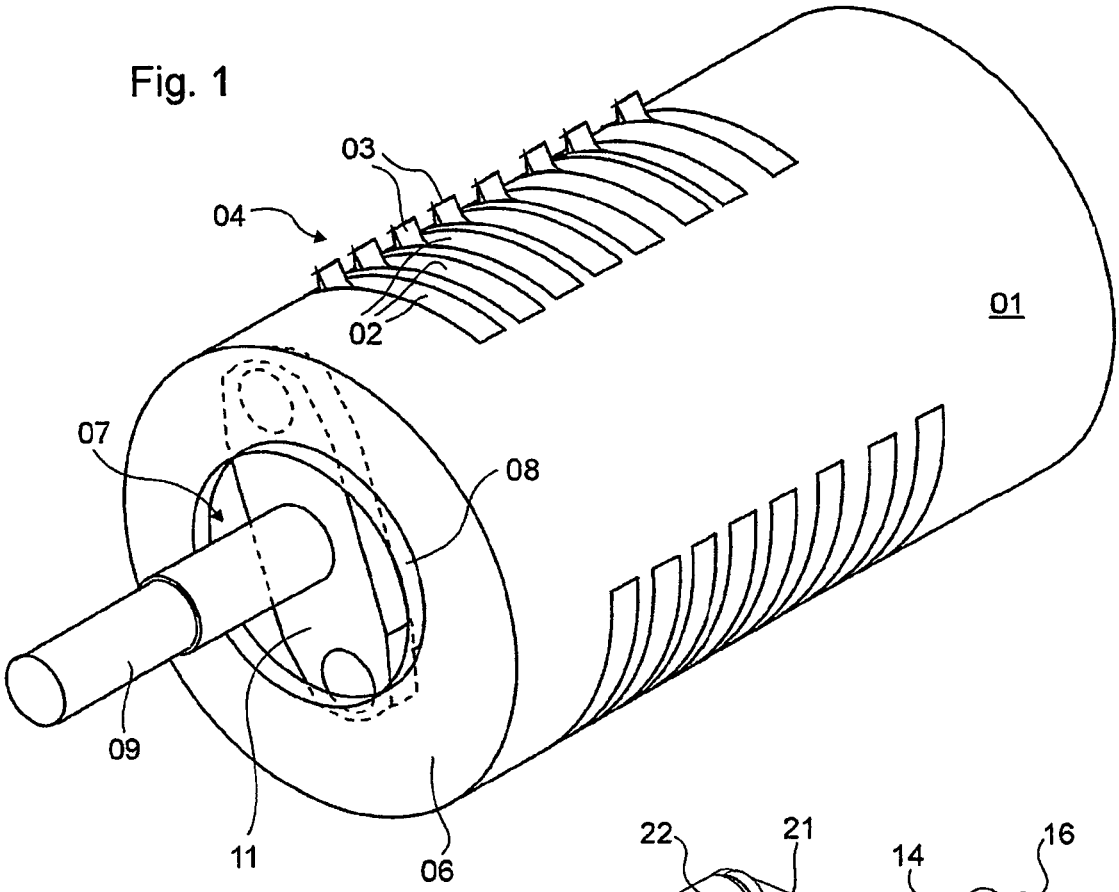
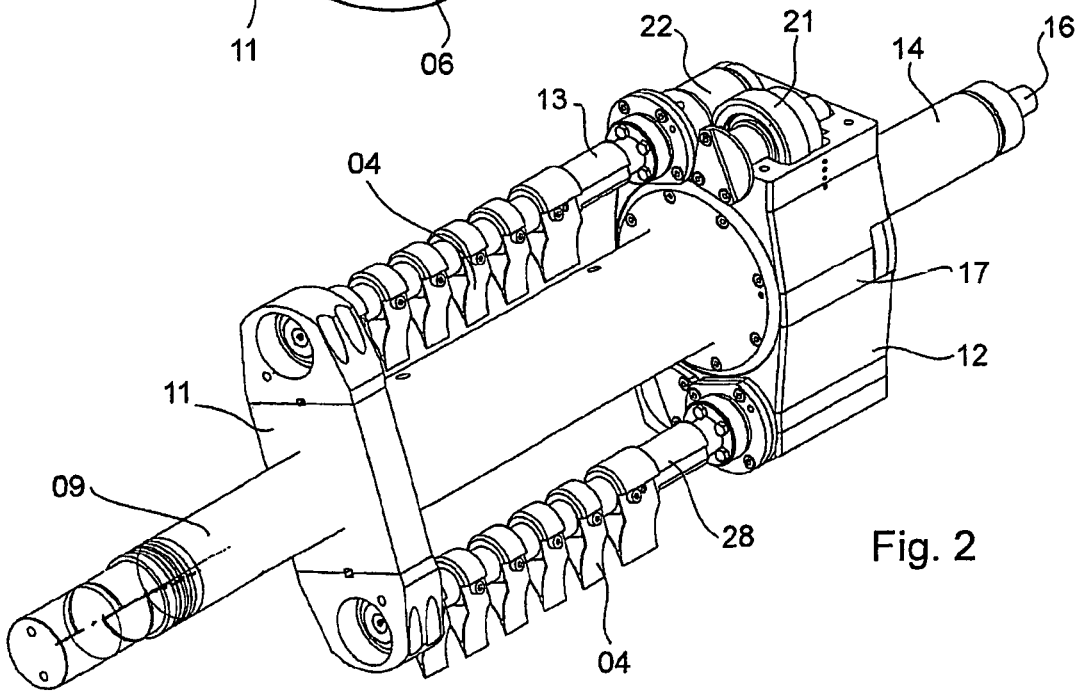
Fig. 2

FOLDING DRUMS OF A FOLDING DEVICE

CROSS-REFERENCE TO RELATED APPLICATIONS

This patent application is the U.S. National Phase, under 35 USC 371 of PCT/DE 03/00268, filed Jan. 31, 2003; published as WO 03/072476 A1 on Sep. 4, 2003, and claiming priority to DE 102 08 017.8 filed Feb. 26, 2002 and to DE 102 08 292.8 also filed Feb. 26, 2002, the disclosures of which are expressly incorporated herein by reference.

FIELD OF THE INVENTION

The present invention is directed to folding drums of a folder. The folding drum has at least one folding element arranged on a support and a gear unit.

BACKGROUND OF THE INVENTION

It is the general purpose of a folding drum to temporarily convey a product, which is to be folded in a folder, and to push the product into a folding jaw of a folding jaw cylinder in an orientation suitable for folding, or, depending on the type of the folder, to transfer the product to two folding rollers, which two folding rollers draw the product, with the desired fold line at the front, into a gap formed between them and to thus fold the product in this way. The folding drum has a plurality of movable folding blades for accomplishing this purpose, which movable folding blades can be extended through openings in a shell of the folding drum in order to insert the product to be folded into a folding jaw or into a gap between two folding rollers.

The extending and retracting movement of the folding blade is coupled to the rotation of the folding drum by the use of a gear. Folders are known, wherein the coupling can be cancelled for one of the two folding blades in the folding drum, and the folding blade can be stopped. This stoppage of one of the folding blades allows for so-called collection production. A product can be transferred to the folding drum at a transfer point and can make a complete revolution on the folding drum without being pushed off by a folding blade. When the product again passes the transfer point, a second product is placed on top of the first one, and both products are moved on together by the folding drum. If now both products are pushed off together by the folding blade, they are folded together.

DE 195 11 054 C2 discloses a drive mechanism for a folding blade of a folding drum. Driving of the folding blade is provided via a central gear wheel.

DE 12 22 082 B1 describes a wheel folder, whose folding blades can be adjusted by an adjusting gear via an axially displaceable gear wheel.

A folding drum of a folder with a folding blade arranged on a support is known from GB 1 059 158 A. A gear wheel, which is arranged coaxially with respect to the axis of rotation of the support is provided, which gear wheel, in one mode of operation, has a number of revolutions which is different from that of the folding drum.

SUMMARY OF THE INVENTION

The object of the present invention is directed to providing folding drums for a folder.

In accordance with the present invention, this object is attained by the provision of a folding drum of a folder having at least one folding element arranged on a support. A gear unit, which has at least one central gear wheel can be arranged coaxially with respect to a rotating shaft of the support. This gear wheel can be shifted axially between two positions. This gear wheel can also have a number of revolutions that is different from the number of revolutions of the folding drum. The folding element may also rotate at one of first and second different numbers of revolutions, or can be stopped. The rotating shaft of the folding element may be located eccentrically with respect to the rotating shaft of the folding drum.

One of the two gear wheel disks is fixed, while the other gear wheel disk rotates as a function of the production mode which is selected.

For engagement, the folding drum is stopped in a defined position, because the gear coupling is unequivocal. Alternatively, the tooth coupling can catch slippingly while the folding drum rotates.

With this folding drum structure, in accordance with the present invention, switching from single to collection production is possible more rapidly and is simpler than with constructions which were previously used.

For the coupling of the first and second gear wheel disk to each other, which is necessary for accomplishing single production, these gear wheel disks are usefully equipped with complementary tooth arrangements, which tooth arrangements can be brought into engagement or out of engagement by axially displacing the first wheel disk.

By the provision of irregular distances or widths of the teeth, these tooth arrangements have been configured in such a way that they can be be brought into engagement by the use of only a small number "m" of evenly distributed rotary positions of the two wheel disks with respect to each other. The number "m" is a function of the gear ratio of the groups of gears. If, with the frame of the gear unit assumed to be fixed, the gear groups convert one revolution of the center wheel to a whole number "n" of revolutions of the folding blades, "m" can be any arbitrary whole number divisor of "n", including 1 or "n". Because of this, it is assured that switching back to single production takes place only when the folding blade, which had previously been deactivated during collection production, is in a correct phase position.

It is possible, in particular, to fix a single defined position.

The first wheel disk preferably has a further, or an additional tooth arrangement, which further tooth arrangement is complementary to a tooth arrangement at the frame of the gear unit, and which can be brought into engagement with the first gear wheel disk by displacing the latter. This further tooth arrangement is used for stopping the folding blade coupled to the first wheel disk during collection production. These tooth arrangements can be brought into engagement with each other in a multitude of rotary positions, so that switching from single to collection production can take place in any arbitrary orientation of the folding drum.

BRIEF DESCRIPTION OF THE DRAWINGS

Preferred embodiments of the present invention are represented in the drawings and will be described in greater detail in what follows.

Shown are in:

FIG. 1, a schematic perspective view of a folding drum, with which the present invention can be used, in FIG. 2, a view, in the same perspective as in FIG. 1, of the internal structure of the folding drum depicted in FIG. 1, in FIG. 3, a schematic representation of a gear unit for the folding drum represented in FIG. 1, and in FIG. 4, an end view of a wheel disk in accordance with the present invention.

DESCRIPTION OF THE PREFERRED EMBODIMENT

Figure 3:
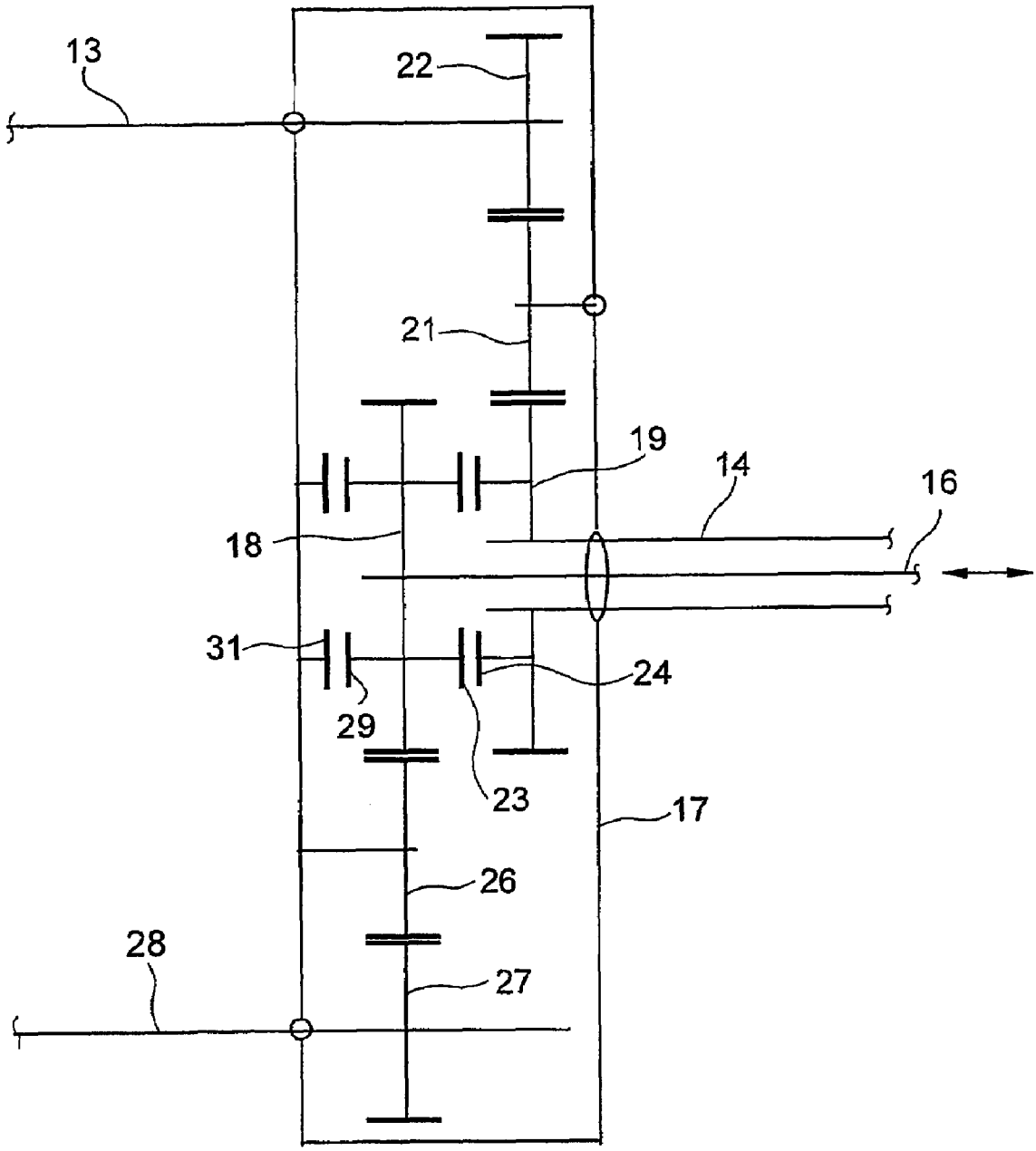

Referring initially to FIG. 1, there may be seen a preferred embodiment of a folding drum of a folding device in accordance with the present invention. Three groups of slits 02, each group of slits 02 being spaced at an angular distance of 120° in a circumferential direction from each other, have been formed in a drum shell 01 of the folding drum which is represented in FIG. 1. A plurality of protruding projections 03 are shown extending radially through the group of slits 02 which are located at the top of the drum shell 01, as seen in FIG. 1, which protruding projections 03 are a part of a folding element 04, such as for example, a folding blade 04. The folding blade 04 is arranged on a support, which structure will be explained in greater detail subsequently, in connection with FIG. 2.

Various function groups, such as, for example, grippers or spur needle strips, for use in holding a product taken along by the folding drum, can be arranged on or at the drum shell 01, which function groups are not shown in FIG. 1 for simplifying the representation in FIG. 1 and which function groups will also not be described, since they are generally known to one skilled in the art and are not further developed or modified by the present invention.

Two end flanges 06, each with an enlarged central opening 07, which central opening 07 is concentric with respect to a longitudinal axis of the drum shell 01, are located at the end faces of the drum shell 01, as seen in FIG. 1. A shaft 08 has been formed at the openings 07 and is used for the rotatable support of the folding drum in a frame, which is not specifically represented, of a folder.

A shaft 09 which supports the internal structure of the folding drum, extends eccentrically through the central opening 07 of the end flange 06.

As is shown in FIG. 2, the eccentrically located shaft 09 has, in the interior of the folding drum, two arms 11, which project in opposite radial directions from shaft 09, and a gear unit 12, which areas 11 and gear unit 12 support two folding blade shafts 13, 28, which two folding blade shafts 13 and 28 are rotatable around axes of rotation which are parallel to the shaft 09. The housing of the gear unit 12 is rigidly connected with the section of the shaft 09 facing the viewer, as depicted in FIG. 2, and is rotatable in the interior of the folding drum together with this section of the shaft 09. On the far side of the gear unit 12, in the perspective view shown in FIG. 2, the shaft 09 is extended by a second shaft section 14, which is here called a second gear wheel disk shaft 14 for reasons which will become clear in connection with the subsequent discussion of FIG. 3. This second gear disk shaft 14 is structured for being mounted non-rotatably in a lateral plate of the folder. A first shaft section 16, which is a so-called first gear wheel disk shaft 16, extends through an axially extending, centralhollow space or bone in the second gear wheel disk shaft 14;

FIG. 3 shows the internal structure of the gear unit 12. The first and second gear wheel disk shafts 16, 14, respectively have been rotatably passed through an opening of the housing 17 or of the frame of the gear unit 12, and respectively support a first gear wheel disk 18 or a second gear wheel disk 19. Since the second gear wheel disk 19 is rigidly connected with the second gear wheel disk shaft 14, it does not follow a rotation of the gear unit 12 around the axis of the shaft 09. In this way, when the gear unit 12 rotates, it drives a gear group constituted by an intermediate gear wheel 21, which intermediate gear wheel 21 is rotatable around a shaft that is connected with the housing 17, and also drives a gear wheel 22 that is fastened on the folding blade shaft 13. While the gear unit 12 rotates around the axis of the eccentrically positioned shaft 09, the folding blade shaft 13 moves on a circular path around the shaft 09, and at the same time, rotates around its own axis. In the process, the tip or tips 03 of the folding blade 04 mounted on the folding blade shaft 13 describes a cycloid. Due to the eccentric arrangement of the shaft 09 with respect to the drum shell 01, the folding blade 04 is extended through the slits 02 of the drum shell 01 at only one location of its cycloidal track. The gear ratio of the gear group 19, 21, 22 must be selected in such a way, that the folding blade shaft 13 performs one entire revolution around itself with every revolution of the gear unit 12. In the situation under discussion, the gear ratio of the gear group 19, 21, 22 has been selected to be such that, with the housing 17 assumed to be fixed, one revolution of the second gear wheel disk 19 drives "n"=3 evolutions of the folding blade 04.

The first gear wheel disk 18 can be displaced axially between first and second positions by axially displacing the first gear wheel disk shaft 16. In the first position, the first gear wheel disk shaft 16 is coupled with the second gear wheel disk shaft 14 via first tooth arrangements 23, 24 arranged on the facing front ends of the two gear wheel disks 18, 19, and in this way is kept immovable with regard to the frame of the folder. In this position, the first gear wheel disk 18 drives another gear wheel group 26, 27, which consists of an intermediate gear wheel 26 and a gear wheel 27 of the second folding blade shaft 28. In this state, the folding blade 04 of the second folding blade shaft 28 moves on the same cycloidal track as that of the first folding blade shaft 13. This state corresponds to single production.

In the second axial position of the first gear wheel disk 18, it is coupled by the use of a second tooth arrangement 29 on its second end face with a tooth arrangement 31, which is fixedly connected with the housing 17. In this position, the first gear wheel disk 18 follows the rotation of the housing 17, and the folding blade 04 of the second folding blade shaft 28 moves on a circular track, on which it does not extend out of the folding drum, i.e. it does not move with respect to the cylinder. This state corresponds to collection production.

Figure 4:
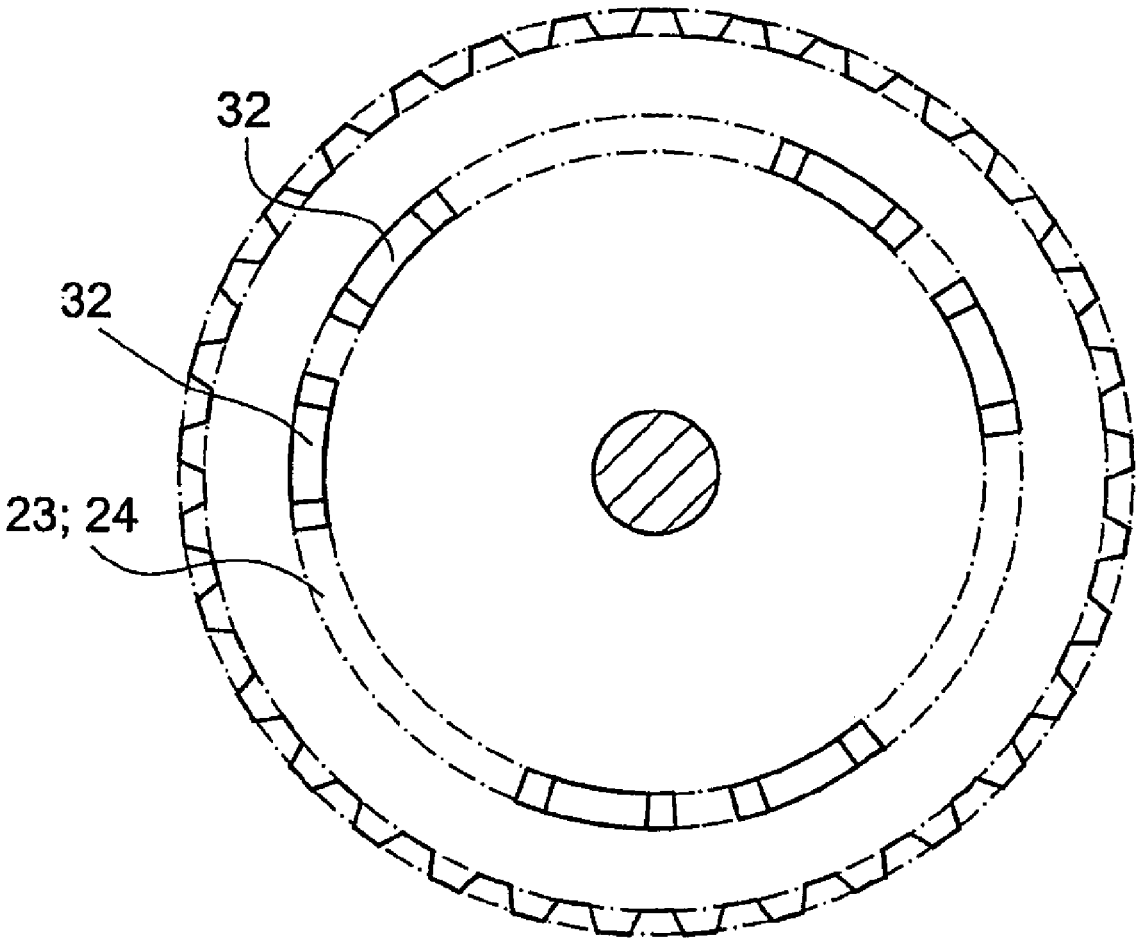

The second tooth arrangements 29, 31 consist of a large number of evenly arranged teeth, which permit their engagement with each other in a plurality of orientations, which plurality of orientations are respectively separated from each other by small angles of rotation. Thus, even when tooth tips of the two second tooth arrangements 29, 31 meet each other in the course of the axial displacement of the first gear wheel disk 18, in relation to the tooth arrangement 31, a slight turning of the housing 17 is sufficient to make an engagement possible. In contrast thereto, as can be seen in FIG. 4, the first tooth arrangements 23, 24 each have a small number of teeth 32, which are of irregular length and which are arranged at irregular distances in order to permit an engagement with each other only in three orientations of the two gear wheel disks 18, 19. It is assured by this structural feature that, when restoring the coupling between the gear wheel disks 18, 19, the folding blade 04 of the temporarily stopped second folding blade shaft 28 is in the same position as prior to the release of the coupling. This could require that, in the course of switching from collection to single production, the folding drum must initially be rotated some distance until the tooth arrangements 23, 24 can be brought into engagement.

The teeth 32 of the first tooth arrangements 23, 24 can also be arranged in such a way that an engagement is only possible in a single position of rotation.

If the gear ratio of the gear groups 19, 21, 22, and 18, 26, 27 would correspond, for example, to "n"=4 revolutions of the folding blade shafts 13, 28 per revolution of the gear wheel disks 18, 19, the teeth 32 could also be arranged in such a way that they would permit "m"=1, 2 or 4 engagement positions.

The change of the number of revolutions of the folding elements 04 is provided by the use of an actuating device, which is arranged coaxially with respect to the rotating shaft 09, 14, 16 of the support, i.e. the shaft 09 or the shaft sections 14 or 16, particularly in the shaft journal.

The rotating shaft of the folding drum, which is not specifically shown, and the rotating shaft 09, 14, 16 of the support are arranged eccentrically with respect to each other. Each folding element 04 is rotatingly arranged on its further rotating shaft 13, 28, as discussed above, each of which rotating folding blade shaft 13, 28 is arranged eccentrically with respect to the rotating shaft 09, 14, 16 of the support.

The described gear structure can also be used for a folding drum which has folding jaws 04 in place of folding blades 04, i.e. for a folding jaw cylinder.

While preferred embodiments of a folding drum of a folding device, in accordance with the present invention, have been set forth fully and completely hereinabove, it will be obvious to one of skill in the art that various changes in, for example, the supports for the folding drum, the type of web being folded, and the like could be made without departing from the true spirit and scope of the present invention which is accordingly to be limited only by the appended claims.

What is claimed is:

1. A folding drum of a folder comprising:

a support;

at least one folding element on said support;

a rotatable shaft of said support and having a support shaft axis of rotation;

a gear unit on said support;

a first central gear wheel having a first central gear wheel axis of rotation and being arranged in said gear unit coaxially with respect to said support shaft axis of rotation;

means for shifting said first central gear wheel axially between at least first and second positions;

a second central gear wheel having a second central gear wheel axis of rotation and being arranged in said gear unit coaxially with respect to said support shaft axis of rotation and said first central gear wheel axis of rotation;

complementary tooth arrangements on end faces of said first and second central gear wheels; and means for selectively displacing said first central gear wheel axially with respect to said second central gear wheel to selectively bring said complimentary end face tooth arrangements into engagement in said first position and out of engagement in said second position.

2. The folding drum of claim 1 wherein in said first position said folding drum performs single production and in said second position said folding drum performs collect production.

3. The folding drum of claim 1 further including an actuating device arranged coaxially with said rotatable shaft of said support.

4. The folding drum of claim 3 wherein said actuating device is at least partially in a shaft journal.

5. The folding drum of claim 1 further including a second folding element and a housing for said gear unit.

6. The folding drum of claim 1 further including a gear group assigned to said at least one folding element.

7. The folding drum of claim 1 wherein said at least one folding element is selectively one of folding blades and folding jaws.

8. The folding drum of claim 7 wherein said folding blade is adapted to perform a retraction movement and an extension movement into and out of a drum shell coupled for rotation with one of said first and second central gear wheels.

9. The folding drum of claim 1 further including at least a second folding element, said first and second folding elements each being supported by a folding blade shaft, each said folding blade shaft being coupled for rotation to a respective one of said first central gear wheel and said second central gear wheel via a gear group.

10. The folding drum of claim 9 wherein each of said gear groups converts one revolution of the associated central gear wheel into a whole number of revolutions n>1 of said associated folding blade shaft.

11. The folding drum of claim 10 wherein tooth arrangement of said first and second central gear wheels can be brought into engagement in "m" orientations and wherein "m" is a divisor of "n".

12. The folding drum of claim 1 wherein said second central gear wheel is fixed in place in respect to a frame of the folder.

13. The folding drum of claim 1 further including first and second folding rollers working together with said folding drum and wherein said folding drum is in a wheel folder.

14. The folding drum of claim 1 further including a support for said folding drum and a rotatable shaft of said folding drum support, said rotatable shaft of said folding drum support and said rotatable shaft of said folding element support being eccentric.

15. The folding drum of claim 14 further including a folding element rotatable shaft arranged eccentrically to said rotating shaft of said support.

16. A folding drum of a folder comprising:

a support;

a first folding element supported on said support by a first folding blade shaft;

a second folding element supported on said support by a second folding blade shaft;

a rotatable shaft of said support and having a support shaft axis of rotation;

a gear unit on said support;

a first central gear wheel having a first central gear wheel axis of rotation and being arranged in said gear unit coaxially with respect to said support shaft axis of rotation; and a second central gear wheel having a second central gear wheel axis of rotation and being arranged in said gear unit coaxially with respect to said support shaft axis of rotation, said first folding blade shaft being coupled for rotation to said first central gear wheel, said second folding blade shaft being coupled for rotation to said second central gear wheel, said first central gear wheel having selectable first and second numbers of revolutions, said folding drum having a number of folding drum revolutions, one of said first central gear wheel's first and second numbers of revolutions being different from said folding drum number of revolutions, one revolution of at least one of said first and second central gear wheels generating a whole number of revolutions n>1 of said associated folding blade shaft.

17. The folding drum of claim 16 further including an actuating device arranged coaxially with said rotatable shaft of said support.

18. The folding drum of claim 17 wherein said actuating device is at least partially in a shaft journal.

19. The folding drum of claim 16 further including a housing for said gear unit.

20. The folding drum of claim 16 further including a separate gear group assigned to each said first and second folding element.

21. The folding drum of claim 16 further including a separate gear wheel group acting with each of said first and second central gear wheels.

22. The folding drum of claim 21 further including coaxial gear wheel shafts for each of said first and second central gear wheels, said separate gear wheel groups being coupled together and separated by displacing one of said gear wheel shafts axially with respect to the other.

23. The folding drum of claim 22 wherein said first and second central gear wheel shafts are parallel to, and are eccentric with respect to said rotating shaft.

24. The folding drum of claim 16 further including complementary tooth arrangements on end faces of said first and second central gear wheels, said first central gear wheel being displaceable axially to bring said complementary tooth arrangements selectively into and out of engagement.

25. The folding drum of claim 24 wherein said tooth arrangements of said first and second central gear wheels are attached to end faces of said first and second central gear wheels.

26. The folding drum of claim 16 wherein said first central gear wheel has a first tooth arrangement and said housing has a second, complementary tooth arrangement, said first central gear wheel being axially displaceable to bring said first and second side face tooth arrangements into and out of engagement with each other.

27. The folding drum of claim 16 wherein each of said first and second folding elements is selectively one of folding blades and folding jaws.

28. The folding drum of claim 27 wherein said folding blade is adapted to perform a retraction movement and an extension movement into and out of a drum shell coupled for rotation with one of said first and second central gear wheels.

29. The folding drum of claim 16 further including first and second folding rollers working together with said folding drum and wherein said folding drum is in a wheel folder.

30. A folding drum of a folder comprising:

a support;

at least one folding element on said support and rotatable in a first mode of operation at a first number of revolutions and rotatable in a second mode of operation at a second number of revolutions a rotatable shaft of said support and having a support shaft axis of rotation and a shaft journal;

at least one folding element rotating shaft arranged eccentrically to said rotatable shaft of said support;

a gear unit on said support;

at least one central gear wheel in said gear unit and having a central gear wheel axis of rotation coaxial with said support shaft axis of rotation, said at least one central gear wheel having selectable first and second numbers of revolutions, said folding drum having a number of folding drum revolutions, one of said first and second central gear wheel numbers of revolutions being different from said folding drum number of revolutions; and an actuating device adapted to change said number of revolutions of said at least one folding element, said actuating device being arranged coaxially to said support shaft axis of rotation and at least partially in said shaft journal.

31. The folding drum of claim 30 wherein said first mode of operation is collection production and said second mode of operation is single production.

32. The folding drum of claim 30 further including a gear group assigned to said at least one folding element.

33. The folding drum of claim 30 wherein said at least one folding element is selectively one of folding blades and folding jaws.

34. The folding drum of claim 33 wherein said folding blade is adapted to perform a retraction movement and an extension movement into and out of a drum shell coupled for rotation with one of said first and second central gear wheels.

35. The folding drum of claim 30 further including first and second folding rollers working together with said folding drum and wherein said folding drum is in a wheel folder.

36. The folding drum of claim 30 further including a support for said folding drum and a rotatable shaft of said folding drum support, said rotatable shaft of said folding drum support and said rotatable shaft of said folding element support being eccentric.

37. The folding drum of claim 36 further including a folding element rotatable shaft arranged eccentrically to said rotating shaft of said support.

* * * * *